US008031839B2

(12) United States Patent
Shimono

(10) Patent No.: US 8,031,839 B2
(45) Date of Patent: Oct. 4, 2011

(54) X-RAY TUBE

(75) Inventor: Takashi Shimono, Nasushiobara (JP)

(73) Assignees: Kabushik Kaisha Toshiba, Tokyo (JP); Toshiba Electron Tubes & Devices Co., Ltd., Tochigi-ken (JP)

( * ) Notice: Subject to any disclaimer, the term of this patent is extended or adjusted under 35 U.S.C. 154(b) by 0 days.

(21) Appl. No.: 12/836,946

(22) Filed: Jul. 15, 2010

(65) Prior Publication Data

US 2010/0278308 A1 Nov. 4, 2010

Related U.S. Application Data

(63) Continuation of application No. PCT/JP2009/050571, filed on Jan. 16, 2009.

(30) Foreign Application Priority Data

Jan. 17, 2008 (JP) ..... 2008-008117

(51) Int. Cl.
*H01J 35/06* (2006.01)

(52) U.S. Cl. ..... 378/136; 378/140

(58) Field of Classification Search ..... 378/136, 378/140

See application file for complete search history.

(56) References Cited

U.S. PATENT DOCUMENTS

| | | | |
|---|---|---|---|
| 3,138,729 A | 6/1964 | Henke | |
| 2005/0175152 A1 | 8/2005 | Smith | |
| 2007/0092064 A1* | 4/2007 | Kuribayashi et al. | 378/136 |

FOREIGN PATENT DOCUMENTS

| | | |
|---|---|---|
| EP | 0 432 568 | 6/1991 |
| JP | 05-314937 | 11/1993 |
| JP | 08-329869 | 12/1996 |
| JP | 09-007534 | 1/1997 |
| JP | 10-255701 | 9/1998 |
| JP | 2005-228696 | 8/2005 |
| JP | 2006-278216 | 10/2006 |
| JP | 2006-524548 | 11/2006 |
| WO | WO 2006/009053 | 1/2006 |

OTHER PUBLICATIONS

Translation for JP 2005-228696 A published on Aug. 25, 2005.*

International Search Report for PCT/JP2009/050571 mailed Mar. 10, 2009.

European Search Report dated May 11, 2011.

* cited by examiner

*Primary Examiner* — Glen Kao

(74) *Attorney, Agent, or Firm* — Pillsbury Winthrop Shaw Pittman, LLP

(57) ABSTRACT

According to one embodiment, a distance from an X-ray tube central axis to an outer side surface of a cathode electron gun in a direction perpendicular to the longitudinal direction of a filament coil is made less than a distance from the X-ray tube central axis to an outer side surface of the cathode electron gun in the longitudinal direction of the filament coil, and a distance from the X-ray tube central axis to an X-ray radiation window in the direction perpendicular to the longitudinal direction of the filament coil is made less than a distance from the X-ray tube central axis to an X-ray radiation window in the longitudinal direction of the filament coil.

4 Claims, 2 Drawing Sheets

X-RAY TUBE

CROSS-REFERENCE TO RELATED APPLICATIONS

This is a Continuation Application of PCT Application No. PCT/JP2009/050571, filed Jan. 16, 2009; which was published under PCT Article 21(2) in Japanese.

This application is based upon and claims the benefit of priority from prior Japanese Patent Applications No. 2008-008117, filed Jan. 17, 2008, the entire content of which are incorporated herein by reference.

FIELD

Embodiments described herein relate generally to an X-ray tube for radiating X-rays.

BACKGROUND

A conventional X-ray tube will be explained below with reference to FIGS. 2A and 2B by taking, as an example, an X-ray tube used in an X-ray diffraction apparatus described in Jpn. Pat. Appln. KOKAI Publication No. 2006-278216. Note that FIG. 2B shows the interior of the X-ray tube viewed along line B-B in FIG. 2A.

An X-ray tube 1 includes a vacuum enclosure 2 having a vacuum interior. The vacuum enclosure 2 is obtained by connecting an insulating enclosure 3 at one end to a metal enclosure 4 at the other end. The X-ray tube 1 also includes a cathode electron gun 6 having a filament coil 5, an anode 7, and X-ray radiation windows 8*a* and 8*b*.

The cathode electron gun 6 is arranged in the vacuum enclosure 2, and supported by the insulating enclosure 3. The filament coil 5 is centered around an X-ray tube central axis O such that the longitudinal direction is a direction perpendicular to the X-ray tube central axis O.

The anode 7 is supported by the metal enclosure 4. The anode 7 is placed in a position on the X-ray tube central axis O where the anode 7 faces the filament coil 5. A focal point 9 is formed into a rectangle on the anode 7. That is, the focal point 9 is formed on the anode 7 when electrons emitted from the filament coil 5 are converged into a rectangular electron beam having a long side in the longitudinal direction of the filament coil 5. Note that the focal point 9 is called a point focus when viewed from the short side of the rectangle, and called a line focus when viewed from the long side of the rectangle.

The X-ray radiation windows 8*a* are formed in the circumferential wall of the metal enclosure 4 in the direction perpendicular to the X-ray tube central axis O and in a direction perpendicular to the longitudinal direction of the filament coil 5. The X-ray radiation windows 8*a* extract, outside the metal enclosure 4, X-rays emitted in the direction perpendicular to the longitudinal direction of the filament coil 5.

The X-ray radiation windows 8*b* are formed in the circumferential wall of the metal enclosure 4 in the longitudinal direction of the filament coil 5. The X-ray radiation windows 8*b* extract, outside the metal enclosure 4, X-rays emitted in the longitudinal direction of the filament coil 5.

As shown in FIG. 2B, the outer circumferential shape of the cathode electron gun 6 is a circle. Also, the outer circumferential shape of the metal enclosure 4 having a restricted electrical insulation distance to the outer circumferential surface of the cathode electron gun 6 is a circle. The X-ray radiation windows 8*a* on the line-focus side and the X-ray radiation windows 8*b* on the point-focus side are arranged in the circumferential wall of the circular metal enclosure 4. Therefore, the distance from the X-ray tube central axis O to the X-ray radiation windows 8*a* on the line-focus side is the same as that from the X-ray tube central axis O to the X-ray tube radiation windows 8*b* on the point-focus side. Note that the center of the focal point 9 as the X-ray generation source of the anode 7 is positioned on the X-ray tube central axis O.

In an X-ray diffraction apparatus and the like, an optical element for collecting X-rays radiated from the X-ray tube 1 is placed at or outside the X-ray radiation window 8*a*. To increase the collection efficiency, this optical element is preferably placed as close as possible to the focal point 9 of the anode 7.

When using X-rays on the line-focus side, however, the distance from the focal point 9 (X-ray tube central axis O) of the anode 7 to the X-ray radiation window 8*a* on the line-focus side is relatively great. When the distance from the focal point 9 to the X-ray radiation window 8*a* is great, it is impossible to well increase the collection efficiency of the optical element.

DETAILED DESCRIPTION

In general, according to one embodiment, an X-ray tube including: a vacuum enclosure; a cathode electron gun formed in the vacuum enclosure and comprising a filament coil which is centered around an X-ray tube central axis and has a longitudinal direction perpendicular to the X-ray tube central axis; an anode formed in the vacuum enclosure to face the filament coil on the X-ray tube central axis; and an X-ray radiation window formed, to face the anode, in a wall of the vacuum enclosure in a direction perpendicular to the longitudinal direction of the filament coil, wherein a distance from the X-ray tube central axis to an outer side surface of the cathode electron gun in the direction perpendicular to the longitudinal direction of the filament coil is less than that from the X-ray tube central axis to an outer side surface of the cathode electron gun in the longitudinal direction of the filament coil, and a distance from the X-ray tube central axis to the wall of the vacuum enclosure, in which the X-ray radiation window is formed, in the direction perpendicular to the longitudinal direction of the filament coil is less than that from the X-ray tube central axis to a wall of the vacuum enclosure in the longitudinal direction of the filament coil.

Hereinafter, an embodiment will be described with reference to the accompanying drawings.

Figure 1A:
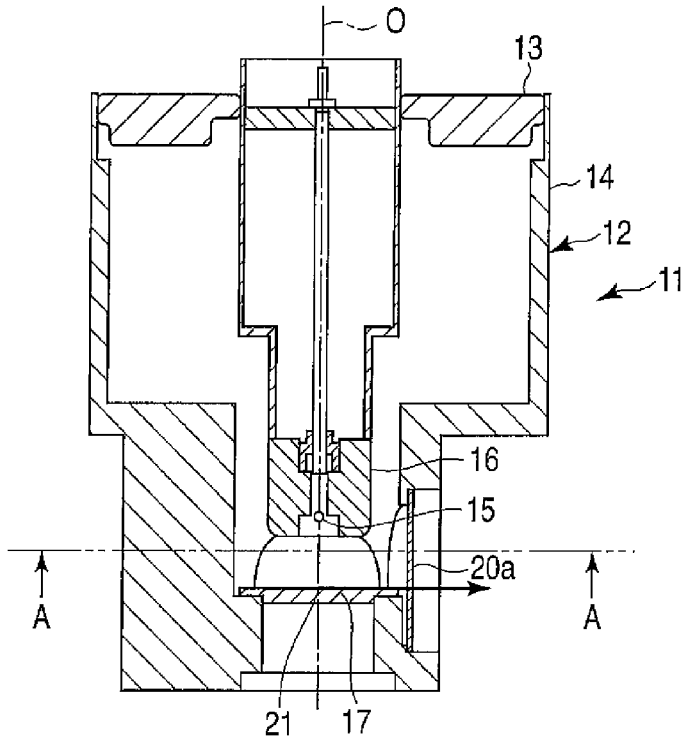
FIG. 1A is a sectional view in which X-rays are radiated to the line-focus side of an X-ray tube according to an embodiment.
Figure 1B:
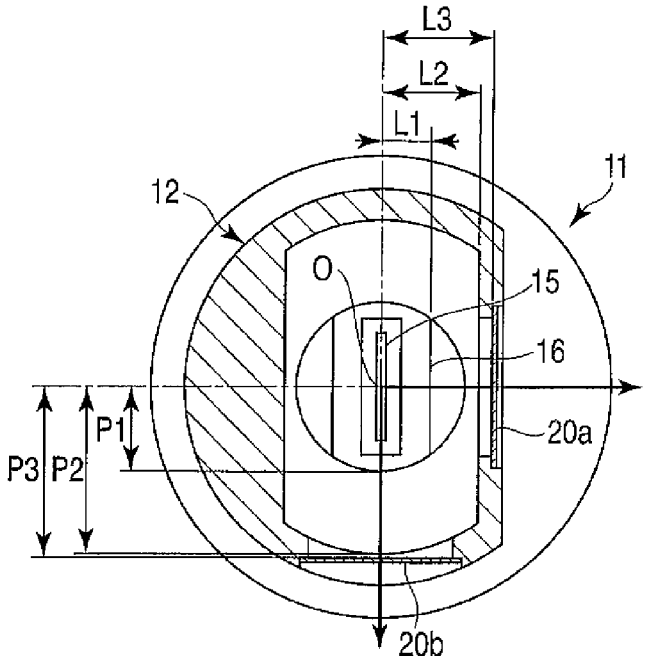
FIG. 1B is a sectional view of the X-ray tube along line A-A in FIG. 1A.
Figure 2A:
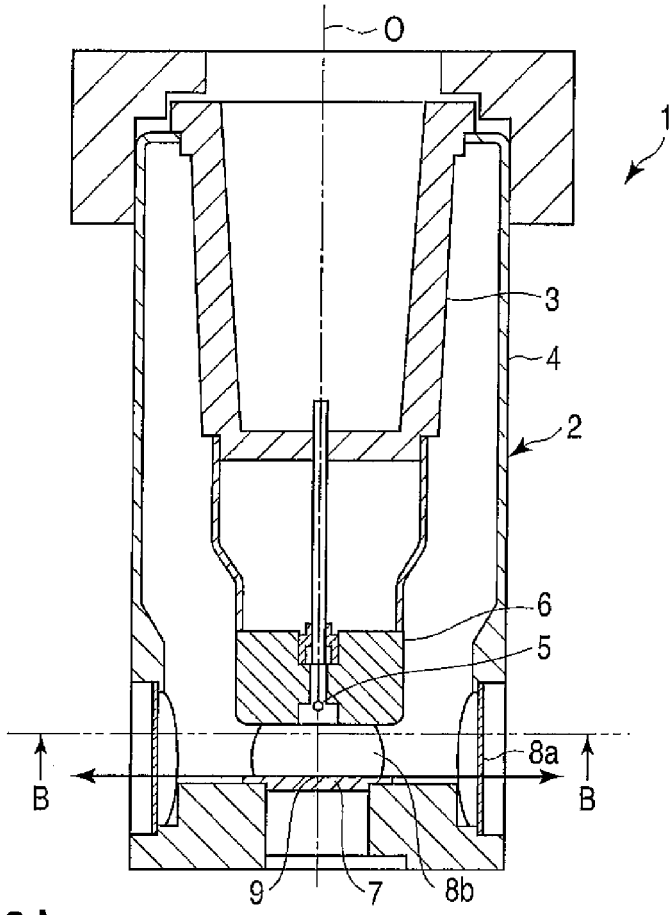
FIG. 2A is a sectional view in which X-rays are radiated to the line-focus side of a conventional X-ray tube.
Figure 2B:
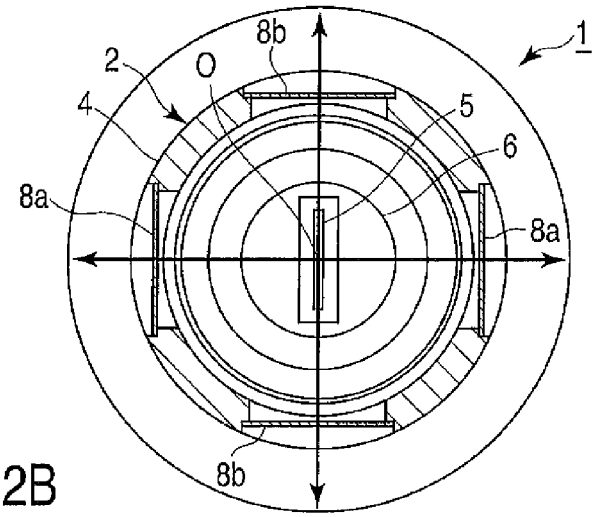
FIG. 2B is a sectional view of the X-ray tube along line B-B in FIG. 2A.

FIG. 1A is a sectional view in the longitudinal direction of a filament coil, in which X-rays are radiated to the line-focus side of an X-ray tube 11. FIG. 1B is a sectional view of the X-ray tube 11 along line A-A in FIG. 1A.

The X-ray tube 11 includes a vacuum enclosure 12 having a vacuum interior. The vacuum enclosure 12 includes a metal enclosure 14, and an insulating enclosure 13 attached to one end of the metal enclosure 14. The X-ray tube 11 also includes a cathode electron gun 16 having a filament coil 15 as an electron emission source, and an anode 17 facing the filament coil 15.

The cathode electron gun 16 is supported by the insulating enclosure 13. Note that when the cathode electron gun 16 is installed in the vacuum enclosure 12, the center of the filament coil 15 is positioned in the center (an X-ray tube central axis O) of the X-ray tube 11. Note also that the filament coil 15 is placed in the cathode electron gun 16 such that the longitudinal direction of the filament coil 15 is a direction perpendicular to the X-ray tube central axis O.

The anode 17 is supported by the metal enclosure 14 in a position where the anode 17 faces the filament coil 15. These configurations give the insulating enclosure 13 the function of a high-voltage receptacle. The metal enclosure 14 and anode 17 are at the ground potential.

X-ray radiation windows 20*a* and 20*b* are formed in the circumferential wall of the metal enclosure 14. The X-ray window 20*a* is formed in the wall on one side of the metal enclosure 14 in the direction perpendicular to the X-ray tube central axis O and in a direction perpendicular to the longitudinal direction of the filament coil 15. The X-ray radiation window 20*a* faces the anode 17. The X-ray radiation window 20*a* extracts, outside the metal enclosure 14, X-rays emitted in the direction perpendicular to the longitudinal direction of the filament coil 15.

The X-ray radiation window 20*b* is formed in the wall on another side of the metal enclosure 14 in the direction perpendicular to the X-ray tube central axis O and in the longitudinal direction of the filament coil 15. The X-ray radiation window 20*b* faces the anode 17. The X-ray radiation window 20*b* extracts, outside the metal enclosure 14, X-rays emitted in the longitudinal direction of the filament coil 15.

The cathode electron gun 16 is formed to have a size necessary to converge electrons emitted from the filament coil 15. The outer side surfaces of the cathode electron gun 16 in the direction perpendicular to the longitudinal direction of the filament coil 15 are formed into flat surfaces parallel to the longitudinal direction of the filament coil 15. Consequently, the cathode electron gun 16 is formed into almost a quadrangle having a long side in the longitudinal direction of the filament coil 15, and a short side in the direction perpendicular to the longitudinal direction of the filament coil 15.

Note that as shown in FIG. 1A, a focal point 21 as an X-ray generation source is positioned on that surface of the anode 17 which faces the filament coil 15, and on the extension line of the X-ray tube central axis O. The focal point 21 is formed into a rectangle on the anode 17. That is, the focal point 21 is formed on the anode 17 when electrons emitted from the filament coil 15 are converged into a rectangular electron beam having a long side in the longitudinal direction of the filament coil 15. Note that the focal point 21 is called a point focus when viewed from the short side of the rectangle, and called a line focus when viewed from the long side of the rectangle.

A distance L1 from the X-ray tube central axis O to the outer side surface of the cathode electron gun 16 in the direction perpendicular to the longitudinal direction of the filament coil 15 is made less than a distance P1 from the X-ray tube central axis O to the outer side surface of the cathode electron gun 16 in the longitudinal direction of the filament coil 15.

To maintain the electrical insulation distance to the cathode electron gun 16, the inner wall surfaces of the metal enclosure 14 are formed to have the same shapes as those of the outer side surfaces of the cathode electron gun 16. The inner walls of the metal enclosure 14 in the direction perpendicular to the longitudinal direction of the filament coil 15 have flat surfaces parallel to the longitudinal direction of the filament coil 15. Also, the inner wall surfaces of the metal enclosure 14 are formed into almost a quadrangle having a long side in the longitudinal direction of the filament coil 15, and a short side in the direction perpendicular to the longitudinal direction of the filament coil 15.

Note that the inner wall surface opposite to the inner wall surface of the metal enclosure 14 in which the X-ray radiation window 20*a* is formed is a flat surface parallel to the longitudinal direction of the filament coil 15.

That is a distance L2 from the X-ray tube central axis O to that inner wall surface of the metal enclosure 14, in which the X-ray radiation window 20*a* is formed, in the direction perpendicular to the longitudinal direction of the filament coil 15 is made less than a distance P2 from the X-ray tube central axis O to the inner wall surface of the metal enclosure 14 in the longitudinal direction of the filament coil 15.

Accordingly, a distance L3 from the X-ray tube central axis O to the X-ray radiation window 20*a* in the direction perpendicular to the longitudinal direction of the filament coil 15 is made less than a distance P3 from the X-ray tube central axis O to the X-ray radiation window 20*b* in the longitudinal direction of the filament coil 15.

As described above, the distance L1 from the X-ray tube central axis O to the outer side surface of the cathode electron gun 16 on the line-focus side is made less than the distance P1 from the X-ray tube central axis O to the outer side surface of the cathode electron gun 16 on the point-focus side. Therefore, the distance L3 from the X-ray tube central axis O to the X-ray radiation window 20*a* on the line-focus side can be made less than the distance P3 from the X-ray tube central axis O to the X-ray radiation window 20*b* on the point-focus side.

When using X-rays on the line-focus side by using the X-ray tube 11 in an X-ray diffraction apparatus, therefore, an optical element for collecting the X-rays can be positioned close to the focal point 21 of the X-ray tube 11. This makes it possible to increase the X-ray collection efficiency.

Note that the X-ray tube 11 is also applicable to an X-ray tube including only the X-ray radiation window 20*a* on the line-focus side. It is also possible to apply the X-ray tube 11 to an X-ray tube including two X-ray radiation windows 20*a* on the line-focus side and two X-ray radiation windows 20*b* on the point-focus side.

In the embodiment, the distance from the X-ray tube central axis to the outer side surface of the cathode electron gun in the direction perpendicular to the longitudinal direction of the filament coil is made less than that from the X-ray tube central axis to the outer side surface of the cathode electron gun in the longitudinal direction of the filament coil. Accordingly, the distance from the X-ray tube central axis to the X-ray radiation window in the direction perpendicular to the longitudinal direction of the filament coil can be made less than that from the X-ray tube central axis to the X-ray radiation window in the longitudinal direction of the filament coil.

When using X-rays on the line-focus side, an optical element for collecting the X-rays can be positioned close to the focal point 21 of the X-ray tube 11. This makes it possible to increase the X-ray collection efficiency. Consequently, the X-ray utilization efficiency increases.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube comprising:

a vacuum enclosure;

a cathode electron gun formed in the vacuum enclosure and comprising a filament coil which is centered around an X-ray tube central axis and has a longitudinal direction perpendicular to the X-ray tube central axis;

an anode formed in the vacuum enclosure to face the filament coil on the X-ray tube central axis; and an X-ray radiation window formed, to face the anode, in a wall of the vacuum enclosure in a direction perpendicular to the longitudinal direction of the filament coil, wherein:

a distance from the X-ray tube central axis to an outer side surface of the cathode electron gun in the direction perpendicular to the longitudinal direction of the filament coil is less than that from the X-ray tube central axis to an outer side surface of the cathode electron gun in the longitudinal direction of the filament coil, a distance from the X-ray tube central axis to the wall of the vacuum enclosure, in which the X-ray radiation window is formed, in the direction perpendicular to the longitudinal direction of the filament coil is less than that from the X-ray tube central axis to a wall of the vacuum enclosure in the longitudinal direction of the filament coil, an outer side surface of the cathode electron gun in the direction perpendicular to the longitudinal direction of the filament coil is formed into a flat surface parallel to the longitudinal direction of the filament coil, and a wall of the vacuum enclosure in the direction perpendicular to the longitudinal direction of the filament coil is formed to have a flat surface parallel to the longitudinal direction of the filament coil.

2. An X-ray tube according to claim 1, wherein an insulating enclosure having a function of a high-voltage receptacle is formed in a portion of the vacuum enclosure.

3. An X-ray tube comprising:

a vacuum enclosure;

a cathode electron gun formed in the vacuum enclosure and comprising a filament coil which is centered around an X-ray tube central axis and has a longitudinal direction perpendicular to the X-ray tube central axis;

an anode formed in the vacuum enclosure to face the filament coil on the X-ray tube central axis; and an X-ray radiation window formed, to face the anode, in a wall of the vacuum enclosure in the longitudinal direction of the filament coil, and an X-ray radiation window formed, to face the anode, in a wall of the vacuum enclosure in the direction perpendicular to the longitudinal direction of the filament coil, wherein:

a distance from the X-ray tube central axis to an outer side surface of the cathode electron gun in the direction perpendicular to the longitudinal direction of the filament coil is less than that from the X-ray tube central axis to an outer side surface of the cathode electron gun in the longitudinal direction of the filament coil, a distance from the X-ray tube central axis to the X-ray radiation window in the direction perpendicular to the longitudinal direction of the filament coil is less than that from the X-ray tube central axis to the X-ray radiation window in the longitudinal direction of the filament coil, an outer side surface of the cathode electron gun in the direction perpendicular to the longitudinal direction of the filament coil is formed into a flat surface parallel to the longitudinal direction of the filament coil, and a wall of the vacuum enclosure in the direction perpendicular to the longitudinal direction of the filament coil is formed to have a flat surface parallel to the longitudinal direction of the filament coil.

4. An X-ray tube according to claim 3, wherein an insulating enclosure having a function of a high-voltage receptacle is formed in a portion of the vacuum enclosure.

* * * * *